United States Patent [19]

Kashima

[11] 4,424,503

[45] Jan. 3, 1984

[54] THREE-PHASE AND THREE-LEG CORE OF CORE-TYPE TRANSFORMER

[75] Inventor: Yoshitake Kashima, Hitachi, Japan

[73] Assignee: Hitachi, Ltd., Tokyo, Japan

[21] Appl. No.: 311,973

[22] Filed: Oct. 16, 1981

[30] Foreign Application Priority Data

Oct. 22, 1980 [JP] Japan ..... 55-148717

[51] Int. Cl.[3] ..... H01F 27/26

[52] U.S. Cl. ..... 336/60; 336/217

[58] Field of Search ..... 336/216, 217, 60, 233, 336/234, 5, 10, 12, 214, 215

[56] References Cited

U.S. PATENT DOCUMENTS 3,283,281 11/1966 Stein et al. ..... 336/217

4,140,987 2/1979 Maezima ..... 336/217 X

*Primary Examiner*—Thomas J. Kozma

*Attorney, Agent, or Firm*—Antonelli, Terry & Wands

[57] ABSTRACT

A three-phase and three-leg core of a core-type transformer comprising three main legs formed of a plurality of steel sheets stacked in the form similar to a circle in cross section and spaced each other, and upper and lower yokes formed of a plurality of steel sheets stacked in the form similar to a circle in cross section for magnetically connecting the main legs. The steel sheets for forming each main leg are cut diagonally at opposite longitudinal ends thereof, and each yoke is formed of two types of steel sheets, one type being of diagonal cuts disposed at opposite longitudinal ends thereof to provide steel sheets of the trapezoidal shape and the other type being of a diagonal cut disposed at one of opposite longitudinal ends thereof and a right angle cut disposed at the other longitudinal end thereof to provide steel sheets of the trapezoidal shape. The steel sheets for forming the upper and lower yokes have a width greater than the width of the steel sheets for forming the main legs. The opposite longitudinal ends of the steel sheets for forming the center main leg are cut diagonally at an angle less than 45 degrees and joined diagonally and at a right angle to the steel sheets for forming the upper and lower yokes through the entire surfaces. The steel sheets for forming the two outer main legs are cut diagonally at opposite longitudinal ends thereof at 45 degrees and joined diagonally to the steel sheets for forming the upper and lower yokes in an area in which the yoke steel sheets are cut diagonally. This construction is conducive to reduced iron loss and to form the main legs of a small diameter.

5 Claims, 16 Drawing Figures

FIG. 1
PRIOR ART
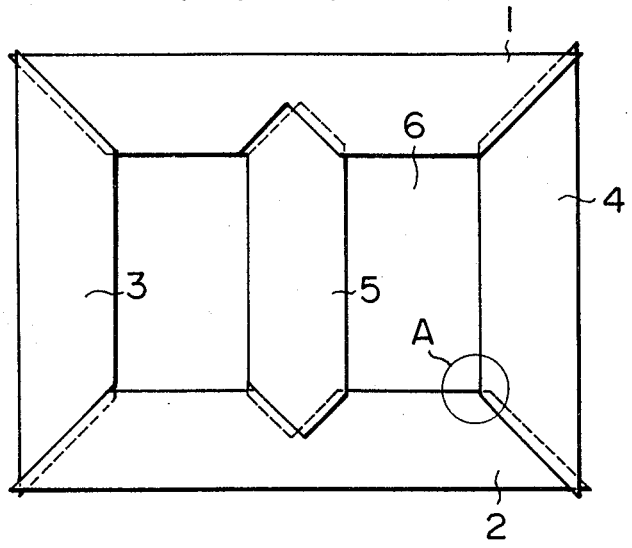
FIG. 2a PRIOR ART
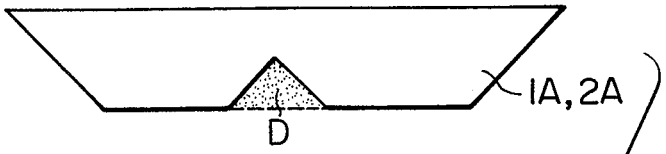
FIG. 2b FIG. 2c
PRIOR ART
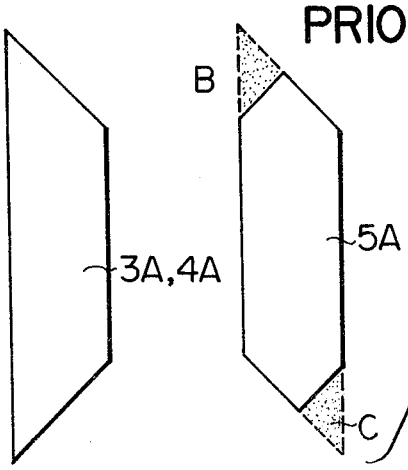
FIG. 2
PRIOR ART FIG. 3
PRIOR ART
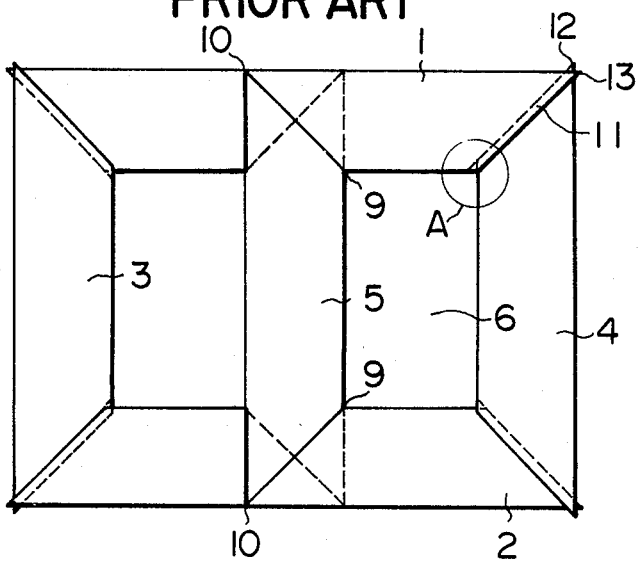
FIG. 4
PRIOR ART
FIG. 4a
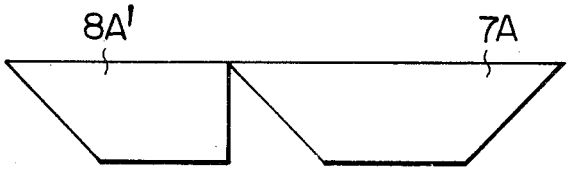
FIG. 4b
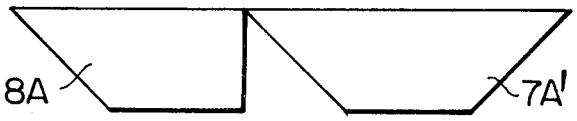
FIG. 4c
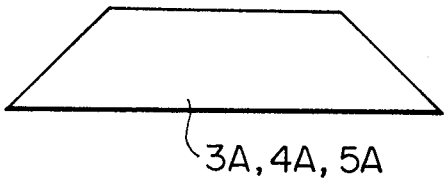

THREE-PHASE AND THREE-LEG CORE OF CORE-TYPE TRANSFORMER

BACKGROUND OF THE INVENTION

This invention relates to three-phase and three-leg cores of core-type transformers, and more particularly, to a three-phase and three-leg core wherein steel sheets or laminations having longitudinal opposite ends thereof cut diagonally are used for forming each main leg and steel sheets having longitudinal opposite ends thereof cut diagonally and steel sheets having one longitudinal end thereof cut diagonally while having the other longitudinal end thereof cut at a right angle are used for forming upper and lower yokes.

Generally, a joint system shown in FIG. 1 or 3 has been in use for a three-phase and three-leg core of a core-type transformer of the prior art. By using these joint systems, a plurality of steel sheet groups differing from one another in width are stacked in laminations, and each main leg is arranged in a core circle contacting the outer ends of the core legs, to provide a three-phase and three-leg core.

Losses suffered by the three-phase and three-leg core of a core-type transformer include an eddy current loss caused by a magnetic flux flowing through the steel sheets, a hysteresis loss, a loss caused by a disturbance of the flow of the magnetic flux through the gaps of the steel sheets, and a loss which is increased by the three-phase magnetic flux in the revolving magnetic field and caused to occur in the joints between the main leg located in the center and the upper and lower yokes. The loss in the joints disposed between the main leg located in the center of the three-phase and three-leg core and the upper and lower yokes is maximized because the conditions referred to hereinabove all occur in these joints and the temperature therein rises to a high level. Thus, limitations are imposed by these conditions on the number and size of cooling oil ducts in the three-phase and three-leg core and the mean magnetic flux density in each main leg. Therefore, in the three-phase and three-leg core, the space factor of the steel sheets with respect to the core circle gets worse than is necessary.

FIG. 1 shows one example of the three-phase and three-leg core of the prior art in which main legs 3, 4 and 5 parallelly spaced and upper and lower yokes 1 and 2 magneticatly connecting the main legs 3, 4 and 5 to one another are formed by stacking a plurality of steel sheet groups. The main legs 3, 4 and 5 and the yokes 1 and 2 are connected together by diagonal joints, and the steel sheets are stacked in such a manner that the joints between the main leg and the yoke alternately move in parallel relationship as indicatd by solid and broken lines.

In this construction, steel sheets 1A and 2A shown in FIG. 2(*a*) which are cut diagonally at opposite longitudinal ends thereof as shown and in which a portion D disposed in the center and forming the joint with the main leg 5 is formed by cutting the material in triangular form are used for forming the upper and lower yokes 1 and 2. Steel sheets 3A and 4A of the trapezoidal shape having longitudinal opposite ends thereof cut diagonally as shown in FIG. 2(*b*) are used for forming the main legs 3 and 4 located on the left side and the right side respectively, and steel sheets 5A having opposite longitudinal ends thereof cut diagonally in triangular form as shown in FIG. 2(*c*) are used for forming the main leg 5 located in the center.

In this joint system, there are the disadvantages that the upper and lower yokes 1 and 2 and the main legs 3, 4 and 5 located at opposite ends and in the center are formed of steel sheets of the same width, so that scrap part is caused at a portion (D) regarding the steel sheets 1A and 2A for forming the upper and lower yokes 1 and 2 and other scrap parts are caused at portions (B and C) regarding the steel sheets 5A for the main leg 5.

On the other hand, a joint system disclosed in U.S. Pat. No. 3,283,281 which is generally referred to as a scrapless system for a three-phase and three-leg core is also used. FIG. 3 shows one example of this system in which steel sheets used for forming the upper and lower yokes 1 and 2 and the main legs 3, 4 and 5 are of the same width, and steel sheet laminations are provided by stacking the steel sheets in such a manner that the diagonal joints are alternately moved as indicated by solid and broken lines. In this core, the upper and lower yokes 1 and 2 are formed of steel sheets 7A and 7A' of the trapezoidal shape having opposite longitudinal ends thereof cut diagonally at 45 degrees and steel sheets 8A and 8A' of the trapezoidal shape having one longitudinal end thereof cut diagonally at 45 degrees and the other longitudinal end thereof cut at a right angle as shown in FIGS. 4(*a*) and 4(*b*). The steel sheets 7A and 8A have a greater length than the steel sheets 7A' and 8A' by an amount corresponding to each of the overlapping diagonal joints of the yokes 1 and 2 with the main legs 4 and 3 located outwardly of the center main leg 5.

The main legs 3, 4 and 5 of the core are formed, as shown in FIG. 4(*c*), of steel sheets 3A, 4A and 5A of the trapiezoidal shape having longitudinal opposite ends thereof cut diagonally at 45 degrees. As a result, the diagonal joints between the upper and lower yokes 1 and 2 and the outer main legs 3 and 4 move in parallel relationship in an overlapping face 11 of an area defined by solid and broken lines, and the diagonal joints between the upper and lower yokes 1 and 2 and the center main leg 5 have inner and outer end edges 9 and 10 reversed as indicated by solid and broken lines in FIG. 3.

The joint system for the three-phase and three-leg core shown in FIG. 3 can obviate the disadvantage of causing scrap end portions in the steel sheets that must be cut off and wasted, as shown in FIG. 1. However, the system shown in FIG. 3 suffers the disadvantage that losses increase at the joints between the upper and lower yokes and each of the main legs.

The joint systems shown in FIGS. 1 and 3 share a defect in that the 45 degree joint faces of the upper and lower yokes 1 and 2 and the outer main legs 3 and 4 are displaced from each other at the overlapping faces 11 due to the fact that the steel sheets forming the upper and lower yokes 1 and 2 and the outer main legs 3 and 4 are of the same width. The result of this is that, in section A in FIGS. 1 and 3, a cutout is formed which causes disturbance of a flow of magnetic flux from the outer main legs 3 and 4 to the upper and lower yokes 1 and 2 to increase. The overlapping face 11 at each joint cannot have its area reduced more than is necessary for maintaining the enough strength of the core, and this tendency exerts greater influences on steel sheets of smaller width. To minimize the disturbance of the magnetic flux, the overlapping face 11 is proportioned such that one-half thereof is disposed on the main leg side and one-half thereof is disposed on the yoke side. This results in projections 12 and 13 extending outwardly of the three-phase and three-leg core as shown in FIG. 3. Of these projections, the projection 13 does not become an obstacle because it extends into a space located inwardly of the diameter of winding not shown. However, the projection 12 extends above and below the three-phase and three-leg core, so that it has to be severed when conditions for transportation of the transformer are severe.

Further, as disclosed in above-noted U.S. Pat. No. 3,283,281, it has been proposed to reduce the width of the steel sheets for forming the main legs of a core as compared with the width of the steels sheets for forming the upper and lower yokes. In such three-phase and three-leg core, the faces cut by 45 degrees causes distinctions in accordance with the width of the steel sheets used, with the result that recesses or cutouts are formed in a section corresponding to section A of FIGS. 1 and 3 and in the joints between the center main leg and the upper and lower yokes. Thus, the three-phase and three-leg core would suffer the disadvantage that the upper and lower yokes are not satisfactorily utilized as magnetic flux passages and that iron loss is high at the joints between the center main leg and the upper and lower yokes.

SUMMARY OF THE INVENTION

An object of the invention is to provide a three-phase and three-leg core of a core-type transformer capable of reducing iron loss at the joints between the main legs parallelly spaced and the upper and lower yokes and at the same time capable of avoiding a rise in temperature at the joints.

Another object is to provide a three-phase and three-leg core of a core-type transformer capable of increasing magnetic flux density in each main leg and improving the space factor of the iron core, whereby an overall compact size can be obtained in a core-type transformer and iron loss can be reduced.

Additional and other objects of the invention will become apparent from the description set forth hereinafter when considered in conjunction with the accompanying drawings.

BRIEF DESCRIPTION OF THE DRAWINGS

FIG. 1 is a schematic view of a three-phase and three-leg core of a core-type transformer of the prior art;

FIGS. 2(*a*), 2(*b*) and 2(*c*) are plan views of steel sheets used for the core shown in FIG. 1;

FIG. 3 is a schematic view of another form of three-phase and three-leg core of a core-type transformer of the prior art;

FIGS. 4(*a*), 4(*b*) and 4(*c*) are plan views of steel sheets used for the core shown in FIG. 3;

DESCRIPTION OF THE PREFERRED EMBODIMENTS

Figure 5:
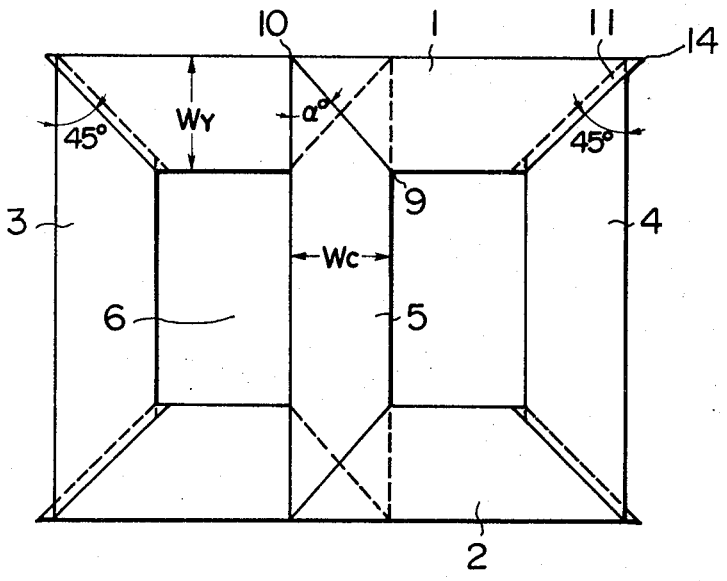
FIG. 5 is a schematic view of the three-phase and three-leg core of a core-type transformer comprising one embodiment of the invention.
Figure 6A:
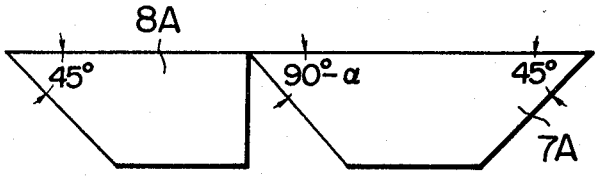
FIGS. 6(*a*), 6(*b*), 6(*c*) and 6(*d*) are plan views of steel sheets used for the core shown in FIG. 5.
Figure 6B:
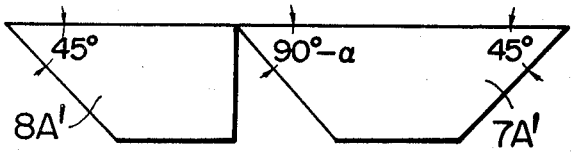
Figure 6C:
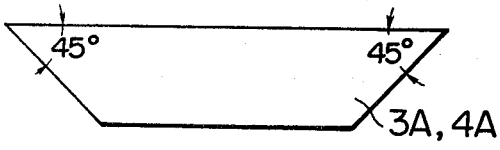
Figure 6D:
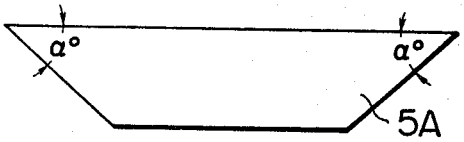

Referring now to the drawings wherein like reference numerals are used throughout the various views to designate like parts and, more particularly, to FIG. 5, according to this figure, a the three-phase and three-leg core of a core-type transformer includes upper and lower yokes 1 and 2, and three spaced main legs 3, 4 and 5 disposed in parallel and magnetically connected to one another by the yokes 1 and 2. Each of the yokes 1 and 2 and the main legs 3, 4 and 5 is formed of a plurality of layered steel sheets stacked into a shape similar to a circle in cross section as subsequently to be described, and they are magnetically connected together by using known diagonal miter joints. In the three-phase and three-leg core according to the invention, the steel sheets for forming the main legs 3, 4 and 5 each have a width Wc which is smaller than the width Wy of the steel sheets for forming the upper and lower yokes 1 and 2, and the upper and lower yokes 1 and 2 are connected to the outer main legs 3 and 4 by diagonal miter joints of 45 degrees while the upper and lower yokes 1 and 2 are connected to the center main leg 5 by a diagonal miter joint of less than 45 degrees and a right angle miter joint.

The upper and lower yokes 1 and 2 and the main legs 3, 4 and 5 of the three-phase and three-leg core shown in FIG. 5 are formed of steel sheets shown in FIGS. 6(*a*), 6(*b*), 6(*c*) and 6(*d*). More specifically, steel sheets 3A, 4A and 5A for forming the outer main legs 3 and 4 and the center main leg 5 each have a width which is smaller than the width of each of steel sheets 7A, 7A', 8A and 8A' for forming the upper and lower yokes 1 and 2, and the steel sheets for forming the outer main legs 3 and 4 and the center main leg 5 are of the same width.

For forming the upper and lower yokes 1 and 2, steel sheets 7A and 7A' are used having a trapezoidal shape with one longitudinal end thereof cut diagonally at 45 degrees and the other longitudinal end thereof cut diagonally at an angle $90-\alpha$ degrees and the steel sheets 8A and 8A' of the trapezoidal shape having one longitudinal and thereof cut diagonally at 45 degrees and the other longitudinal end thereof cut at a right angle as shown in FIGS. 6(*a*) and 6(*b*). For forming the outer main legs 3 and 4, there are used steel sheets 3A and 4A of the trapezoidal shape each having longitudinal opposite ends thereof cut diagonally at 45 degrees as shown in FIG. 6(*c*). For forming the center main leg 5, steel sheets 5A of the trapezoidal shape having longitudinal opposite ends thereof cut diagonally at an angle $\alpha$ which is less than 45 degrees as shown in FIG. 6(*d*) are used.

Steel sheet laminations are stacked to constitute the outer main legs 3, 4 and the upper and lower yokes 1, 2, alternately in overlapping relationship as indicated by solid and broken lines in FIG. 5. The outer main legs 3 and 4 are connected diagonally to the upper and lower yokes 1 and 2 at an angle of 45 degrees. In this construction, overlapping faces 14 at the diagonal joints are formed such that upper and lower ends of the steel sheets constituting the outer main legs 3 and 4 do not extend above and below the upper and lower yokes 1 and 2. The diagonally cut portions of the outer main legs 3 and 4 are formed such that they are miter-jointed to the upper and lower yokes 1 and 2 within the range of the diagonally cut portions of the yokes 1 and 2 each of which portions is cut diagonally at 45 degrees. Thus, the three-phase and three-leg core according to the invention is free from the defect that the disturbance of the magnetic flux is caused by the cutouts as is the case with a three-phase and three-leg core of the prior art.

The steel sheets used for forming the center main leg 5 have their longitudinal opposite ends cut diagonally at an angle $\alpha$ which is less than 45 degrees, and the steel sheets for forming the upper and lower yokes 1 and 2 to be connected to the aforesaid steel sheets have their longitudinal opposite ends cut at $90-\alpha$ degrees. Thus, by connecting these steel sheets by diagonal miter joints, the joints become longer in length than the joints obtained by connecting the steel sheets cut diagonally at 45 degrees.

Assume that the steel sheets for forming the center main leg 5 are cut diagonally at 42.5 degrees, for example. Then the ratio of the width Wy of the steel sheets for forming the yokes 1 and 2 to the width Wc of those for forming the main legs 3, 4 and 5 is $Wy/Wc=1.09$. When the ratio becomes smaller or 0.06 in value, for example, the forward end of the steel sheets for forming the center main leg 5 extends beyond the steel sheets for forming the yokes 1 and 2, provided that the diagonal cut angle $\alpha$ remains unchanged. When the projections have electrically adverse effects, portions thereof that extend beyond the yokes may be cut off without any trouble.

In the three-phase and three-leg core of the first embodiment of the invention, the steel sheets are prepared for each component part of the core on a mass production basis and they are free from scrap parts that should be cut off as waste material. Since the steel sheets for forming the upper and lower yokes 1, 2 each have a width greater than that of the steel sheets for forming the main legs 3, 4, 5, there increases the length of the diagonal joints between the upper and lower yokes and the main legs 3, 4, 5, thereby reducing magnetic flux density. Since the reduction rate of iron loss is proportional to several powers of the magnetic flux density, losses and a rise in temperature in the joints are reduced. Thus, the three-phase and three-leg core according to the invention is more advantangeous than that of the prior art wherein the density of the magnetic flux must be reduced due to increased losses and a rise in temperature in the joints. Thus, in the present invention, it is possible to keep the magnetic flux density high in the main legs 3, 4, 5 and to reduce the number and size of the cooling ducts, in comparison with the conventional core. Thus, the space factor of the iron core of the present invention can be improved. This means that if the amount of magnetic flux remains equal to that of the conventional core, the main legs can have their diameters reduced, thereby making it possible to obtain an overall compact size in a three-phase and three-leg core and to reduce iron loss. Meanwhile, the steel sheets for forming the outer main legs 3, 4 are connected to those for forming the yokes 1, 2 at their joints in an area in which they are cut diagonally at 45 degrees, and no projections extend from the diagonal joints above and below the yokes 1, 2. So long as no special problems arise, the need to cut off the end portions of the steel sheets is eliminated. Moreover, since the width of the main legs 3, 4, 5 is smaller than that of the upper and lower yokes 1, 2, the main legs 3, 4, 5 are in contact with the yokes 1, 2 through the entire length of the cut of 45 degrees or less, so that losses in the joints can be minimized.

Figure 7:
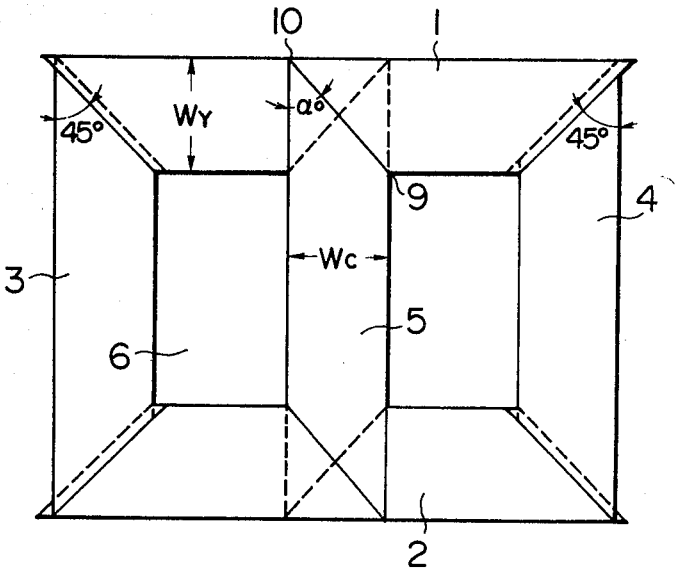
FIGS. 7, 8 and 9 are schematic views of the three-phase and three-leg cores of core-type transformers comprsiing other embodiments of the invention.

In the embodiment shown and described hereinabove, the center main leg 5 is formed of steel sheets of the trapezoidal shape having longitudinal opposite ends thereof cut diagonally at an angle $\alpha$, as shown in FIG. 6(*d*). It is to be understood that the same effects as achieved by the embodiment shown in FIGS. 5 and 6 can be achieved by the embodiment shown in FIG. 7 in which steel sheets, in the form of a paralleloogram angled at opposite ends thereof at $\alpha$ degrees, are used for forming the center main leg 5. In this construction, no trouble occurs in the production process because the difference between the embodiment shown in FIG. 5 and the embodiment shown in FIG. 7 is only in the point that the arrangement of the steel sheets for forming the lower yoke 2 in FIG. 7 is reversed at right and left from that in FIG. 5.

Figure 8:
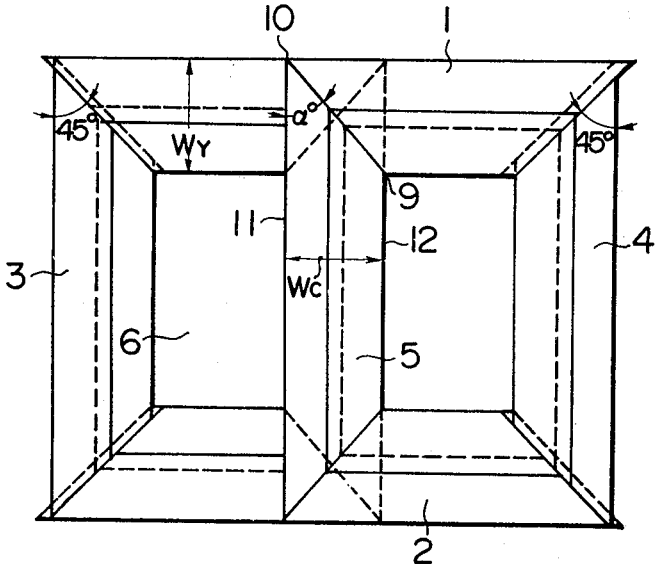

FIG. 8 shows a still another embodiment of the three-phase and three-leg core in conformity with the invention in which steel sheets of a larger width and steel sheets of a smaller width are used in combination for forming the upper and lower yokes 1 and 2 and the main legs 3, 4 and 5, to obtain predetermined dimensions. This construction enables a core-type transformer of a large capacity with yokes 1, 2 and main legs 3, 4, 5 of large sizes to be readily produced without any trouble.

Figure 9:
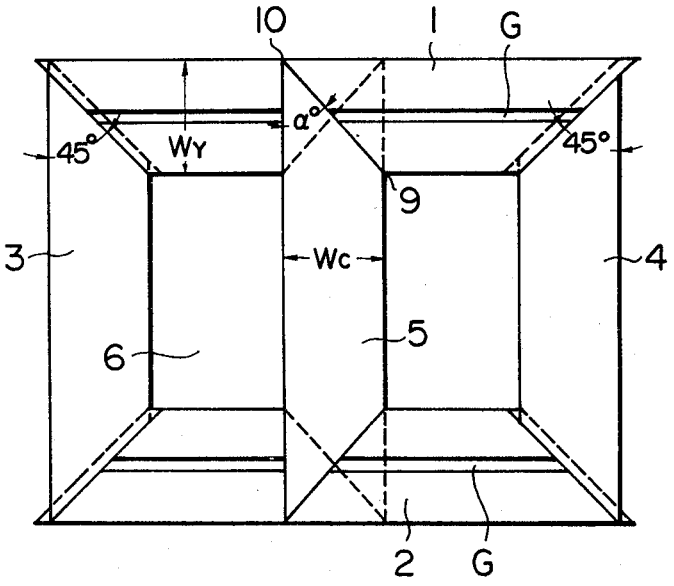

FIG. 9 shows a further embodiment of the three-phase and three-leg core in conformity with the invention in which a gap G is formed in each of the upper and lower yokes 1 and 2 to allow insulating oil to flow therethrough for cooling the iron core. The gap G is formed by forming each of the yokes 1 and 2 with two steel sheets spaced with a suitable spacing therebetween. The provision of the gap G in each of the yokes 1 and 2 enables a rise in temperature to be effectively suppressed in the core.

From the foregoing description, it will be appreciated that according to the invention a three-phase and three-leg core of a core-type transformer is produced by using steel sheets of larger width for forming the upper and lower yokes 1, 2 and steel sheets of smaller width for forming the main legs 3, 4, 5, the steel sheets for forming the center main leg 5 disposed between the outer main legs 3, 4 have their longitudinal ends cut at an angle less than 45 degrees and joined to the steel sheets forming the upper and lower yokes 1, 2 diagonally and at a right angle substantially through the entire surfaces, and the steel sheets for forming the outer main legs 3, 4, or the main legs disposed on the right and left of the center main leg 5 have their longitudinal opposite ends cut diagonally at 45 degrees and joined diagonally to the steel sheets for forming the yokes 1, 2 in an area in which the yokes 1, 2 are cut diagonally. By virtue of this construction, it is possible to reduce the magnetic flux density in the diagonal joints formed in the core, thereby reducing iron loss and avoiding a rise in temperature. Thus, the three-phase and three-leg core according to the invention can increase the magnetic flux density in the main legs as compared with the same type of core of the prior art. This is conductive to reduced dimensions of the main legs 3, 4, 5 and the yokes 1, 2 and reduced coils, thereby enabling a compact overall size to be obtained in a core-type transformer.

What is claimed is:

1. A three-phase and three-leg core of a core-type transformer comprising three main legs spaced in parallel each of which is formed of a plurality of steel sheets stacked to form a substantially circular cross section, and upper and lower yokes each formed of a plurality of steel sheets stacked to form a substantially circular cross section for magnetically connecting said main legs, the steel sheets forming each of said main legs being diagonally cut at opposite longitudinal ends thereof and the steel sheets forming each of said yokes being cut in two different fashions, one fashion of which is of diagonal cuts disposed at opposite longitudinal ends thereof to provide steel sheets of the trapezoidal shape and the other fashion being of a diagonal cut disposed at one of opposite longitudinal ends thereof and a right angle cut disposed at the other longitudinal end thereof to provide steel sheets of the trapezoidal shape, each of the steel sheets in a layer forming each of said yokes being provided with a width greater than a width of each of the steel sheets in the same layer forming each of said main legs;

the longitudinal opposite ends of each of the steel sheets for forming the center main leg of said three main legs interposed between the two outer main legs being cut diagonally at an angle less than 45 degrees and joined diagonally and at a right angle to the steel sheets for forming said upper and lower yokes substantially through the entire surfaces; and the longitudinal ends of each of the steel sheets for forming the two outer main legs disposed on opposite sides of the center main leg being cut diagonally at 45 degrees and joined diagonally to the steel sheets for forming the upper and lower yokes in an area in which each of the yoke steel sheets is cut diagonally.

2. A three-phase and three-leg core as claimed in claim 1, wherein the steel sheets for forming said center main leg are diagonally cut at their longitudinal opposite ends to provide steel sheets of the trapezoidal shape.

3. A three-phase and three-leg core as claimed in claim 1, wherein the steel sheets for forming the center main leg are diagonally cut at their longitudinal opposite ends to provide steel sheets in the form of a parallelogram.

4. A three-phase and three-leg core as claimed in claim 1, wherein each of said main legs and each of said yokes are formed by stacking two types of steel sheets different in width, which main legs are arranged in spaced juxtaposed relation each other.

5. A three-phase and three-leg core as claimed in claim 1, wherein each of said yokes is formed with an oil duct extending through the entire length thereof.

* * * * *